US009834922B2

(12) United States Patent
Boyd et al.

(10) Patent No.: US 9,834,922 B2
(45) **Date of Patent: *Dec. 5, 2017**

(54) EMBEDDED DOWEL INSERTS

(71) Applicants: Stephen Boyd, Holbrook, NY (US); Joseph Accetta, Old Bridge, NJ (US)

(72) Inventors: Stephen Boyd, Holbrook, NY (US); Joseph Accetta, Old Bridge, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/293,401

(22) Filed: Oct. 14, 2016

(65) Prior Publication Data

US 2017/0051500 A1 Feb. 23, 2017

Related U.S. Application Data

(63) Continuation of application No. 13/964,834, filed on Aug. 12, 2013, now Pat. No. 9,469,994.

(60) Provisional application No. 61/683,042, filed on Aug. 14, 2012.

(51) Int. Cl.

| | |
|---|---|
| ***E04B 1/41*** | (2006.01) |
| ***E04B 1/48*** | (2006.01) |
| ***E01C 23/04*** | (2006.01) |
| ***E04C 5/16*** | (2006.01) |
| ***E04G 21/18*** | (2006.01) |

(52) U.S. Cl.

CPC ..... *E04B 1/4114* (2013.01); *E01C 23/04* (2013.01); *E04B 1/41* (2013.01); *E04B 1/48* (2013.01); *E04B 1/483* (2013.01); *E04C 5/161* (2013.01); *E04G 21/185* (2013.01)

(58) Field of Classification Search

CPC ... E04B 1/48; E04B 1/483; E04B 1/41; E01C 11/14; E01C 23/04; E04G 21/185

See application file for complete search history.

(56) References Cited

U.S. PATENT DOCUMENTS 1,045,562 A * 11/1912 Kennedy ..... E04B 1/4121 411/180
2,976,069 A * 3/1961 Meredith ..... E04B 1/48 29/426.5
5,005,331 A * 4/1991 Shaw ..... E01C 11/14 52/396.02
5,216,862 A * 6/1993 Shaw ..... E01C 11/14 52/396.02
5,487,249 A * 1/1996 Shaw ..... E04B 1/483 404/60
5,618,125 A * 4/1997 McPhee ..... E01C 11/14 403/12
5,761,870 A * 6/1998 Goto ..... F16B 13/141 403/268
5,941,045 A * 8/1999 Plehanoff ..... E01C 11/14 52/396.02
7,874,762 B2 * 1/2011 Shaw ..... E01C 11/14 404/60
7,967,528 B2 6/2011 Mercer et al.
(Continued)

*Primary Examiner* — Andrew J Triggs
(74) *Attorney, Agent, or Firm* — Osborne Law LLC

(57) ABSTRACT

A dowel supporting device that includes a substantially hollow tube having a top end and a bottom end. An opening may be formed at the top end and a base may be formed at the bottom end. The base of the dowel supporting device may be fastened to a concrete deck. Concrete may be poured into the concrete deck. When dowels are ready to be used, the dowels may be inserted and secured to the dowel supporting device.

20 Claims, 3 Drawing Sheets

(56) References Cited

U.S. PATENT DOCUMENTS

| | | | | |
|---|---|---|---|---|
| 8,142,104 | B2 | 3/2012 | Mercer et al. | |
| 8,511,033 | B2 | 8/2013 | Kumakawa et al. | |
| 9,340,969 | B1 * | 5/2016 | Shaw | E01C 11/06 |
| 2006/0080932 | A1 * | 4/2006 | Van Rijn | E04G 21/185 52/705 |
| 2009/0139179 | A1 * | 6/2009 | Bennett | B28B 7/30 52/741.1 |
| 2010/0086351 | A1 * | 4/2010 | Mercer | E04B 1/483 404/52 |
| 2014/0047787 | A1 * | 2/2014 | Boyd | E04C 5/161 52/301 |
| 2017/0051500 | A1 * | 2/2017 | Boyd | E04B 1/4114 |

* cited by examiner

EMBEDDED DOWEL INSERTS

CROSS-REFERENCE TO RELATED APPLICATIONS

This application claims the benefit of priority of U.S. provisional application No. 61/683,042 filed Aug. 14, 2012, the contents of which are herein incorporated by reference. This application is a continuation of application Ser. No. 13/964.834, the disclosure of which is incorporated herein by reference.

BACKGROUND OF THE INVENTION

The present invention relates to embedded dowel inserts and, more particularly, to embedded dowel inserts for concrete application.

Currently, during new concrete construction, steel dowels may be embedded in the concrete for the construction of a budding. The steel dowels are left exposed and protruding from the cured concrete. The dowels may expose construction workers to impalement. To prevent this, the dowels need to be covered with materials.

As can be seen,her need for a device that prevents the dowels from being exposed.

SUMMARY OF THE INVENTION

In one aspect of the present invention, a dowel supporting device comprises: a substantially hollow tube having a top end and a bottom end, wherein the substantially hollow tube forms an opening at the top end formed to receive a dowel: and a base at the bottom end comprising a fastening component.

In another aspect of the present invention, a method of securing dowels during construction comprises: providing at least one substantially hollow tube having a top end and a bottom end, wherein the substantially hollow tube forms an opening at the top end, and the bottom end comprises a base; fastening the base of the substantially hollow tube to a concrete deck; pouring concrete within the concrete deck; and inserting a dowel into the opening of the substantially hollow tube.

These and other features, aspects and advantages of the present invention will become better understood with reference to the following drawings, description and claims.

DETAILED DESCRIPTION OF THE INVENTION

Figure 1:
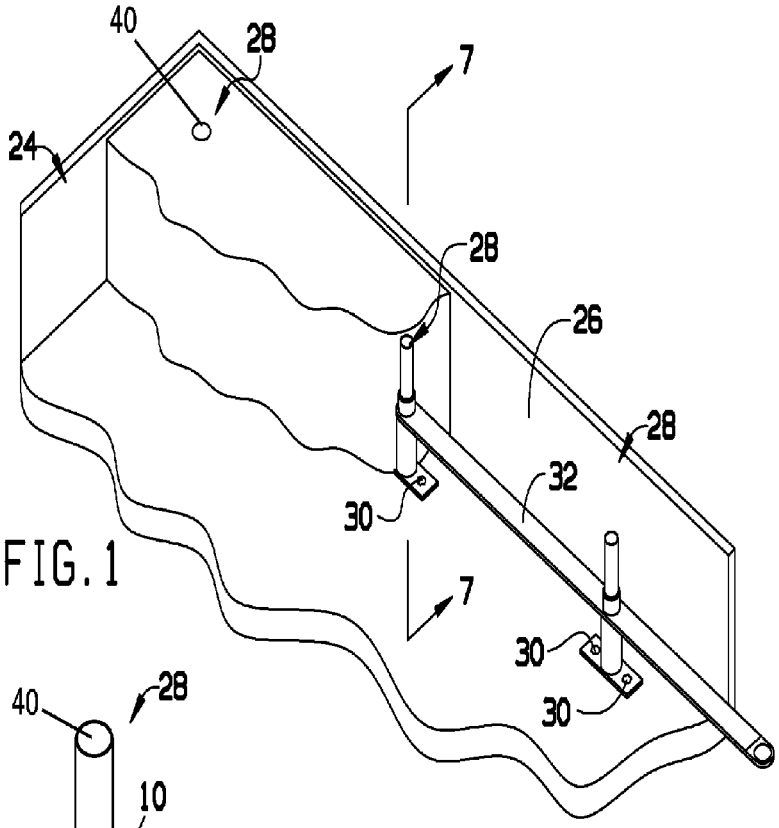
FIG. 1 is a perspective view of the present invention in use.
Figure 5:
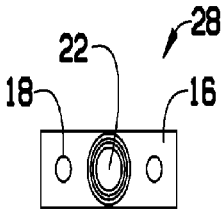
FIG. 5 is a top view of the present invention.
Figure 2:
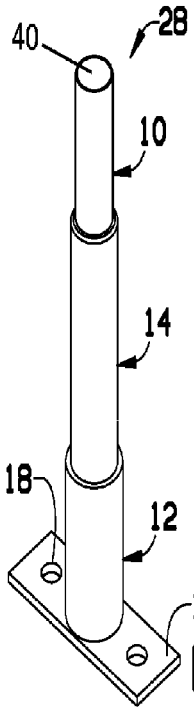
FIG. 2 is a perspective view of the present invention.
Figure 3:
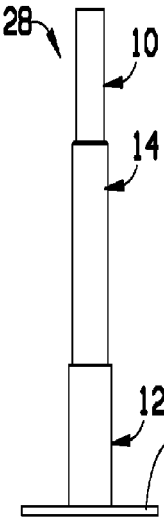
FIG. 3 is a front view of the present invention.
Figure 4:
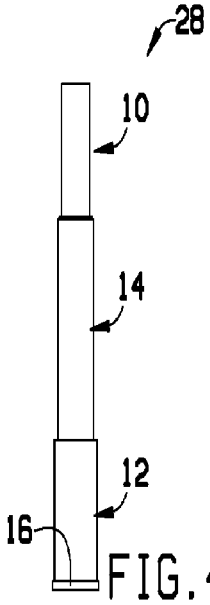
FIG. 4 is a side view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a dowel supporting device that is a substantially hollow tube having a top end and a bottom end. An opening may be formed at the top end and a base may be formed at the bottom end. The base of the dowel supporting device may be fastened to a concrete deck. Concrete may be poured into the concrete deck. When dowels are ready to be used, the dowels may be inserted into and secured to the dowel supporting device.

The present invention may include a pre-molded assembly of tubes installed in concrete to support metal dowels. The pre-molded tube assemblies may be placed and mechanically fastened to surfaces prior to the placement of concrete. Once the concrete has been laid, and the use for dowels is needed, the steel dowels may be placed and secured within the tubes. In certain embodiments, epoxy may be used within the tubes to secure the metal dowels.

This process may eliminate the dangerous exposure of dowels that could be the cause of impalement. In addition, the process may reduce the cost of maintaining exposed dowels by using covers. The tubes of the present invention may be made of a resin, or non-corrosive lightweight material including but not limited to polymers, such as plastic, polyvinyl chloride, and fiberglass.

Referring to FIGS. 1 through 12, the present invention may include a dowel insert tube 28 that may include a top end and a bottom end. The dowel insert tube 28 forms an opening 40 at the top end shaped to receive a dowel 36. A base 16 may form at the bottom end. In certain embodiments, the base 16 may include fastener holes 18 in which fasteners 30, such as bolts or screws, may be secured through to fasten the base 16 to a surface of a concrete deck 24.

In certain embodiments the dowel insert tube 28 may include an adjustable leg section 12 near the bottom end, a mid section 14 and an upper tube section 10 near the top end. The leg section 12 may have a larger diameter than the mid section 14 and the mid section 14 may have a larger diameter than the upper tube section 10. The leg section 12, mid section 14, and upper tube section 10 may telescope relative to one another to adjust the height of the dowel insert tube 10.

Figure 6:
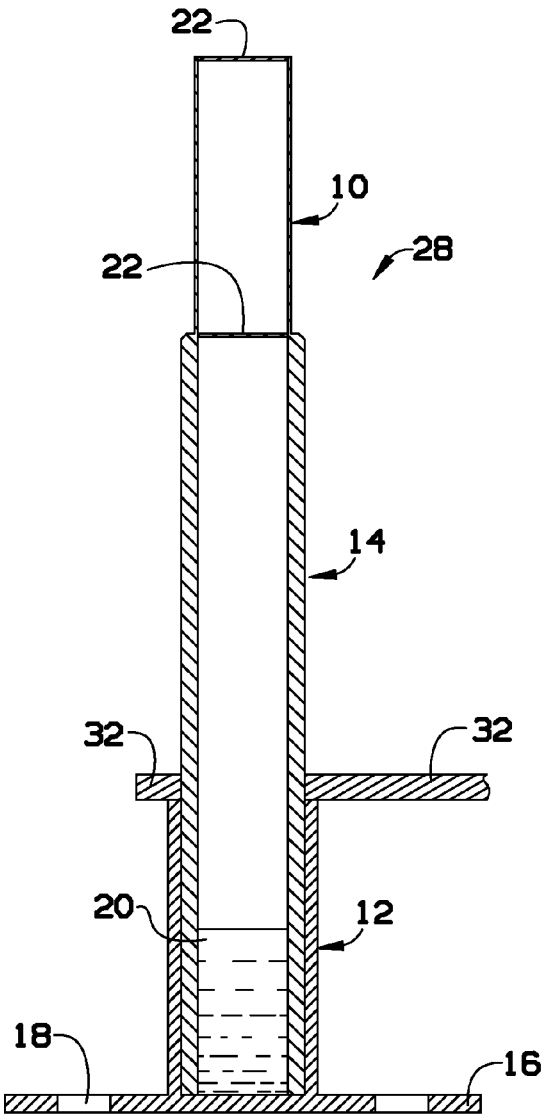
FIG. 6 is a section view of the present invention along line 7-7 in FIG. 1.
Figure 7:
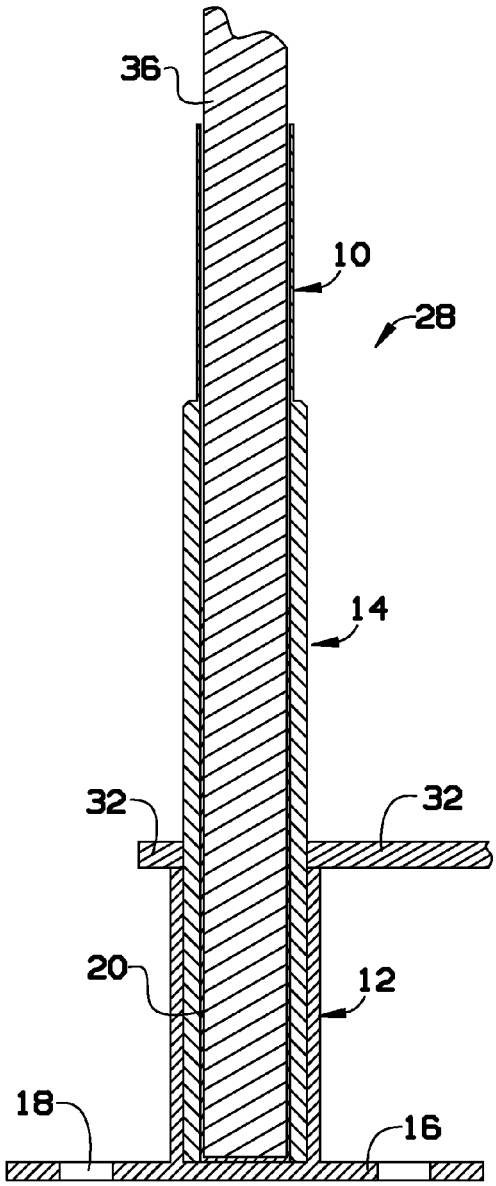
FIG. 7 is a section view of the present invention along line 7-7 in FIG. 1 illustrated with a dowel inserted.
Figure 8:
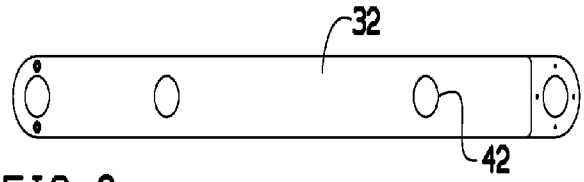
FIG. 8 is a top view of a rigid plastic tie of present invention.
Figure 9:
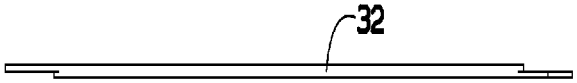
FIG. 9 is a side view of the rigid plastic tie of FIG. 8.
Figure 10:
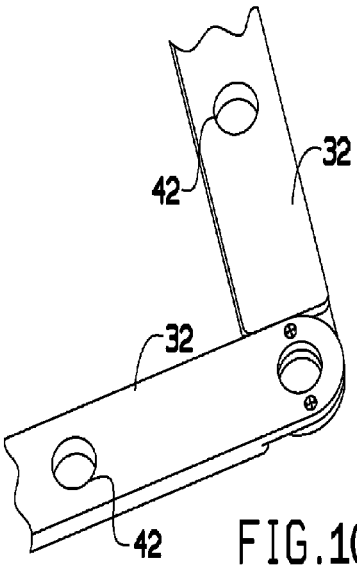
FIG. 10 is a perspective view of two rigid plastic ties joined together.
Figure 11:
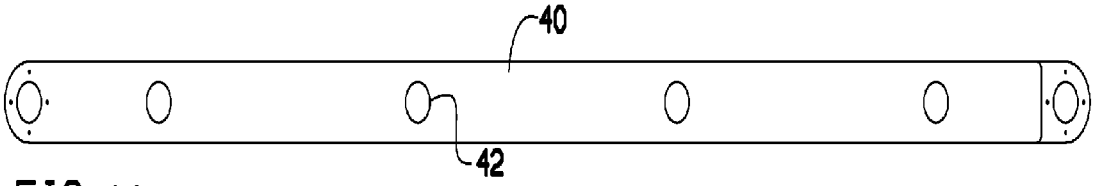
FIG. 11 is a top view of an alternative rigid plastic tie of the present invention.
Figure 12:
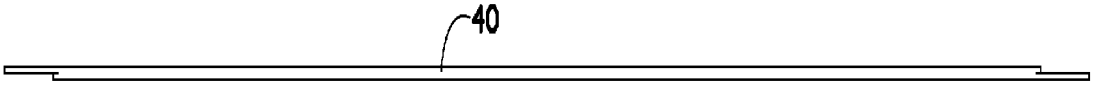
FIG. 12 is a side view of the rigid plastic tie of FIG. 11.

In certain embodiments he present invention may have a cap 22 such as a thin sealed covering. As illustrated in FIG. 6, the cap 22 may be located at the top of the upper tube section 10 as well as the top of the mid section 14. In certain embodiments, glue, such as epoxy 20 may be stored within the dowel insert tube 28 and the cap 22 may preserve the epoxy 20. Therefore, when the dowel insert tube 28 is ready to be used, the cap 22 may be removed or punctured by the dowel 36 and the dowel 36 may be placed within the tube 28. Alternatively, the cap 22 may be removed and epoxy 20 may be inserted into the tube 28. Then the dowel 36 may be placed within the dowel insert tube 28. The epoxy 20 may secure the dowel 36 in the dowel insert tube 28.

The present invention may further include ties 32. In certain embodiments, the ties 32 may be rigid plastic ties 32. The ties 32 may be used to align the dowel insert tubes 28 prior to the concrete filling. The ties 32 may be substantially straight and have a substantially flat body portion, which may include openings 42. The openings 42 may fit over the upper 10 and mid sections 14 and may rest on the lip of the leg section 12. Therefore, the dowel insert tubes 28 may be easily aligned prior to mounting the base 16. In certain embodiments, the ties 42 may include ends that may be joined with one another. The ends may pivot relative to one another so that a user may align the dowel insert tubes 28 at angles.

A method of securing the dowels during construction may include the following. At least one substantially hollow tube having a top end and a bottom end may be provided. The hollow tube may form an opening at the top end, and the bottom end may include a base. The base may be fastened to a concrete deck. Concrete may be poured into the concrete deck and surround the hollow tubes. The concrete may solidify around the hollow tubes. Dowels may then be placed within the tubes when construction is ready to continue.

In certain embodiments, the at least one substantially hollow tube may be a plurality of substantially hollow tubes. Therefore a tie having a substantially flat body portion having openings may be provided. The tie may be placed over the plurality of substantially hollow tubes to align the plurality of substantially hollow tubes prior to fastening the hollow tubes to the concrete deck. This allows for proper alignment of the dowels once inserted into the tubes.

It should be understood, of course, that the foregoing relates to exemplary embodiments of the invention and that modifications may be made without departing from the spirit and scope of the invention as set forth in the following claims.

What is claimed is:

1. A dowel supporting device comprising:

a substantially hollow tube having a top end and a bottom end distal from the top end, wherein the substantially hollow tube forms an opening at the top end leading into the substantially hollow tube, wherein the tube is sized to receive and secure a dowel by insertion of a dowel through the opening at the top end; and a base at the bottom end of the hollow tube distal from the top end, wherein the base is supported by a concrete deck such that the hollow tube is in an upright vertical position relative to the concrete deck, wherein the concrete deck is a substantially horizontal surface configured to receive a concrete pour to produce a substantially horizontal concrete slab, wherein the dowel is inserted into the opening at the top end of the hollow tube after the concrete around the hollow tube has solidified and wherein the dowel is supported by the hollow tube in an upright vertical position.

2. The dowel supporting device of claim 1, wherein the tube further comprises at least a leg section near the bottom end and a middle section above the leg section, wherein the leg section has a larger diameter than the middle section, thereby forming a lip.

3. The dowel supporting device of claim 2, wherein the tube further comprises an upper tube section at the top end, wherein the upper tube section has a smaller diameter than the middle section.

4. The dowel supporting device of claim 2, further comprising a plurality of straight ties each having a substantially flat surface and a plurality of openings formed to fit around the middle section and rest against the lip of the leg section, wherein the ties are placed over the plurality of substantially hollow tubes to vertically align said tubes and wherein the plurality of straight ties are pivotally disposed relative to one another.

5. The dowel supporting device of claim 1, further comprising a fastening component which secures the base to the concrete deck.

6. The dowel supporting device of claim 1, further comprising a thin sealed covering at the top end of the hollow tube to cover the opening at the top end during a concrete pour, and wherein the covering is punctured by the dowel during dowel insertion after the concrete solidifies around the tube.

7. The dowel supporting device of claim 1, wherein the dowel is secured within the hollow tube after insertion of the dowel into the tube.

8. The dowel supporting device of claim 7, further comprising a glue within the hollow tube which secures the dowel within the hollow tube after insertion of the dowel.

9. A dowel supporting device comprising:

a plurality of substantially hollow tubes each having a top end and a bottom end distal from the top end, wherein each substantially hollow tube forms an opening at the top end leading into the substantially hollow tube, wherein the tube is sized to receive and secure a dowel by insertion of a dowel through the opening at the top end;

a base at the bottom end of each hollow tube distal from the top end, wherein the base is supported by a concrete deck such that each hollow tube is in an upright vertical position relative to the concrete deck, wherein the concrete deck is a substantially horizontal surface configured to receive a concrete pour to produce a substantially horizontal concrete slab, wherein the dowels are inserted into the openings at the top ends of the hollow tubes after the concrete around the hollow tubes has solidified and wherein the dowels are supported by the hollow tubes in an upright vertical position; and a plurality of straight ties comprising a plurality of openings formed to fit around a plurality of hollow tubes, wherein the ties are placed over the plurality of substantially hollow tubes to vertically align said tubes and wherein the plurality of straight ties are pivotally connected to one another.

10. The dowel supporting device of claim 9, wherein the tube further comprises at least a leg section near the bottom end and a middle section above the leg section, wherein the leg section has a larger diameter than the middle section, thereby forming a lip.

11. The dowel supporting device of claim 9, wherein the tube further comprises an upper tube section at the top end, wherein the upper tube section has a smaller diameter than the middle section.

12. The dowel supporting device of claim 9, further comprising a thin sealed covering at the top end of the hollow tube to cover the opening at the top end during a concrete pour, and wherein the covering is punctured by the dowel during dowel insertion after the concrete solidifies around the tube.

13. The dowel supporting device of claim 9, wherein the dowel is secured within the hollow tube after insertion of the dowel into the tube.

14. The dowel supporting device of claim 13, further comprising a glue within the hollow tube which secures the dowel within the hollow tube after insertion of the dowel.

15. A dowel supporting device comprising:

a substantially hollow tube having a top end and a bottom end distal from the top end, wherein the substantially hollow tube forms an opening at the top end leading into the substantially hollow tube, wherein the tube is sized to receive and secure a dowel by insertion of a dowel through the opening at the top end; and a base at the bottom end of the hollow tube distal from the top end, wherein the base is supported by a concrete deck such that the hollow tube is in an upright vertical position relative to the concrete deck, wherein the concrete deck is a substantially horizontal surface configured to receive a concrete pour to produce a substantially horizontal concrete slab, wherein the dowel is inserted into the opening at the top end of the hollow tube after solidifying of the concrete around the hollow tube, wherein the dowel is supported by the hollow tube in an upright vertical position and wherein a thin sealed covering at the top end of the hollow tube covers the opening at the top end during a concrete pour, and wherein the covering is punctured by the dowel during dowel insertion after the concrete solidifies around the tube.

16. The dowel supporting device of claim 15, wherein the tube further comprises at least a leg section near the bottom end and a middle section above the leg section, wherein the leg section has a larger diameter than the middle section, thereby forming a lip.

17. The dowel supporting device of claim 15, wherein the tube further comprises an upper tube section at the top end, wherein the upper tube section has a smaller diameter than the middle section.

18. The dowel supporting device of claim 15, further comprising a plurality of straight ties having a substantially flat surface and a plurality of openings formed to fit around the middle section and rest against the lip of the leg section, wherein the ties are placed over the plurality of substantially hollow tubes to vertically align said tubes and wherein the plurality of straight ties are pivotally disposed relative to one another.

19. The dowel supporting device of claim 15, wherein the dowel is secured within the hollow tube after insertion of the dowel into the tube.

20. The dowel supporting device of claim 19, further comprising a glue within the hollow tube which secures the dowel within the hollow tube after insertion of the dowel.

* * * * *